US009724573B2

(12) United States Patent
Kawaguchi et al.

(10) Patent No.: US 9,724,573 B2
(45) **Date of Patent: *Aug. 8, 2017**

(54) GOLF CLUBS AND GOLF CLUB HEADS

(71) Applicants: Nike, Inc., Beaverton, OR (US); Mitsubishi Rayon Co., Ltd., Tokyo (JP)

(72) Inventors: Hiroshi Kawaguchi, Southlake, TX (US); Michael L. Kelly, Portland, OR (US); Hitoshi Kodama, Aichi (JP); Tsuneo Takano, Aichi (JP)

(73) Assignee: Karsten Manufacturing Corporation, Phoenix, AZ (US)

( * ) Notice: Subject to any disclaimer, the term of this patent is extended or adjusted under 35 U.S.C. 154(b) by 78 days.

This patent is subject to a terminal disclaimer.

(21) Appl. No.: 14/158,188

(22) Filed: Jan. 17, 2014

(65) Prior Publication Data

US 2014/0171218 A1 Jun. 19, 2014

Related U.S. Application Data

(60) Continuation of application No. 13/366,869, filed on Feb. 6, 2012, now Pat. No. 8,632,420, which is a (Continued)

(51) Int. Cl.
*A63B 53/04* (2015.01)

(52) U.S. Cl.
CPC .... *A63B 53/0466* (2013.01); *A63B 2053/045* (2013.01); *A63B 2053/0416* (2013.01); *A63B 2053/0433* (2013.01); *A63B 2053/0437* (2013.01); *A63B 2053/0491* (2013.01); *A63B 2209/02* (2013.01); *A63B 2209/023* (2013.01); *Y10T 29/49947* (2015.01); *Y10T 156/1043* (2015.01)

(58) Field of Classification Search
CPC ..... A63B 53/0466; A63B 2053/0416; A63B 2209/023; A63B 2053/0433; A63B 2053/0437; A63B 2209/02; A63B 2053/0491; A63B 2053/045; Y10T 156/1043; Y10T 29/49947
USPC ..... 473/324–350, 287–292
See application file for complete search history.

(56) References Cited

U.S. PATENT DOCUMENTS 4,553,755 A * 11/1985 Yamada ..... A63B 53/04 473/338
4,795,159 A * 1/1989 Nagamoto ..... A63B 53/04 473/338

(Continued)

FOREIGN PATENT DOCUMENTS

JP 59090578 5/1984
JP 0489071 3/1992

(Continued)

*Primary Examiner* — Sebastiano Passaniti

(57) ABSTRACT

A golf club head enables the initial velocity of a ball to be increased and enables the carry to be lengthened. In some example structures, the golf club includes a face plate formed from metal and club head body (e.g., a crown and sole) formed from fiber reinforced plastic. A weighted body is provided inside the rearmost portion of the golf club head and a low rigidity portion whose width becomes gradually narrower as it approaches the rearmost portion is provided in the crown extending from the vicinity of the face plate to the rearmost portion.

18 Claims, 7 Drawing Sheets

Related U.S. Application Data continuation of application No. 12/829,541, filed on Jul. 2, 2010, now Pat. No. 8,110,060, which is a division of application No. 11/773,323, filed on Jul. 3, 2007, now Pat. No. 7,775,903, which is a continuation of application No. 10/935,744, filed on Sep. 8, 2004, now Pat. No. 7,258,625.

(56) References Cited

U.S. PATENT DOCUMENTS 4,900,029 A * 2/1990 Sinclair ..... A63B 53/04 473/327
5,004,241 A * 4/1991 Antonious ..... A63B 53/04 473/327
5,067,715 A * 11/1991 Schmidt ..... A63B 53/04 473/311
5,154,424 A * 10/1992 Lo ..... A63B 53/04 473/338
5,255,913 A 10/1993 Tsuchida
5,398,746 A * 3/1995 Igarashi ..... A63B 53/0466 164/108
5,505,448 A * 4/1996 Park ..... A63B 53/04 473/327
5,570,886 A 11/1996 Rigal et al.
5,624,331 A 4/1997 Lo et al.
5,658,207 A * 8/1997 Aizawa ..... A63B 53/04 473/328
5,669,827 A 9/1997 Nagamoto
5,961,394 A 10/1999 Minabe
5,967,904 A 10/1999 Nagai et al.
6,010,411 A 1/2000 Reyes
6,045,455 A 4/2000 Kosmatka et al.
6,146,287 A 11/2000 Rugge et al.
6,231,455 B1 5/2001 Chang
6,244,976 B1 6/2001 Murphy et al.
6,248,025 B1 * 6/2001 Murphy ..... A63B 53/04 473/324
6,319,148 B1 11/2001 Tom
6,332,847 B2 12/2001 Murphy et al.
6,348,015 B1 2/2002 Kosmatka
6,354,962 B1 3/2002 Galloway et al.
6,354,963 B1 3/2002 Kodama et al.
6,368,234 B1 4/2002 Galloway
6,371,868 B1 4/2002 Galloway et al.
6,381,828 B1 5/2002 Boyce et al.
6,386,990 B1 5/2002 Reyes et al.
6,390,933 B1 5/2002 Galloway et al.
6,398,666 B1 6/2002 Evans et al.
6,406,378 B1 6/2002 Murphy et al.
6,406,381 B2 6/2002 Murphy et al.
6,425,832 B2 7/2002 Cackett et al.
6,435,977 B1 8/2002 Helmstetter et al.
6,435,978 B1 8/2002 Galloway et al.
6,435,980 B1 8/2002 Reyes et al.
6,435,982 B1 8/2002 Galloway et al.
6,440,008 B2 8/2002 Murphy et al.
6,440,011 B1 8/2002 Hocknell et al.
6,450,896 B1 9/2002 Chen
6,450,898 B1 9/2002 Nesbitt et al.
6,471,604 B2 10/2002 Hocknell et al.
6,475,845 B2 11/2002 Kimura
6,478,692 B2 11/2002 Kosmatka
6,490,592 B1 12/2002 St. Denis et al.
6,491,592 B2 12/2002 Cackett et al.
6,506,127 B2 1/2003 Helmstetter et al.
6,508,127 B1 1/2003 Namerikawa et al.
6,527,650 B2 3/2003 Reyes et al.
6,547,676 B2 4/2003 Cackett et al.
6,558,271 B1 5/2003 Beach et al.
6,565,452 B2 * 5/2003 Helmstetter ..... A63B 53/02 473/324
6,575,845 B2 6/2003 Galloway et al.
6,582,321 B2 6/2003 Galloway et al.
6,582,323 B2 6/2003 Soracco et al.
6,592,466 B2 7/2003 Helmstetter et al.
6,592,488 B2 7/2003 Gassmann
6,595,871 B2 7/2003 Sano
6,602,149 B1 8/2003 Jacobson
6,607,452 B2 8/2003 Helmstetter et al.
6,607,623 B2 8/2003 Murphy et al.
6,612,938 B2 9/2003 Murphy et al.
6,620,056 B2 9/2003 Galloway et al.
6,623,377 B2 9/2003 Evans et al.
6,645,087 B2 * 11/2003 Yabu ..... A63B 53/0466 473/342
6,648,773 B1 11/2003 Evans
6,659,884 B2 12/2003 Knuth
6,659,885 B1 12/2003 Knuth
6,669,578 B1 12/2003 Evans
6,669,579 B2 12/2003 Kosmatka
6,676,536 B1 1/2004 Jacobson
6,685,576 B2 2/2004 Kosmatka
6,767,422 B1 7/2004 Atsumi et al.
6,849,003 B2 2/2005 Kumamoto
6,855,068 B2 2/2005 Antonious
6,872,152 B2 3/2005 Beach et al.
6,945,876 B2 9/2005 Nakahara et al.
7,037,214 B2 5/2006 Nakahara et al.
7,128,664 B2 10/2006 Onoda et al.
7,147,576 B2 12/2006 Imamoto et al.
7,211,006 B2 5/2007 Chang
7,258,625 B2 * 8/2007 Kawaguchi ..... A63B 53/0466 473/329
7,338,390 B2 3/2008 Lindsay
7,347,795 B2 3/2008 Yamagishi et al.
7,435,188 B2 10/2008 Tateno et al.
7,775,903 B2 * 8/2010 Kawaguchi ..... A63B 53/0466 473/329
8,110,060 B2 * 2/2012 Kawaguchi ..... A63B 53/0466 156/242
8,632,420 B2 * 1/2014 Kawaguchi ..... A63B 53/0466 473/329
2001/0049310 A1 12/2001 Cheng et al.
2002/0082115 A1 6/2002 Reyes et al.
2002/0108735 A1 8/2002 Kuo
2002/0113338 A1 8/2002 Murphy et al.
2002/0169034 A1 11/2002 Hocknell et al.
2003/0013547 A1 1/2003 Helmstetter et al.
2003/0083151 A1 5/2003 Nakahara et al.
2003/0100381 A1 5/2003 Murphy et al.
2003/0148822 A1 8/2003 Knuth
2003/0153401 A1 8/2003 Helmstetter et al.
2003/0176238 A1 9/2003 Galloway et al.
2003/0186760 A1 10/2003 Lee
2004/0018891 A1 1/2004 Antonious
2004/0053705 A1 3/2004 Kumamoto
2004/0116208 A1 6/2004 De Shiell et al.
2005/0215351 A1 9/2005 Hasegawa
2005/0250596 A1 11/2005 Chuang
2005/0252596 A1 11/2005 Olsen et al.
2006/0052181 A1 3/2006 Serrano et al.
2006/0079349 A1 4/2006 Rae et al.

FOREIGN PATENT DOCUMENTS

JP 2773009 12/1993
JP H08-215355 A 8/1996
JP 2000126339 A 5/2000
JP 2002-113134 A 4/2002
JP 2002-136625 A 5/2002
JP 2002-336389 A 11/2002
JP 2003093554 A 4/2003
JP 2003144590 A 5/2003
JP 2003-210621 A 7/2003
JP 2003-250938 A 9/2003
JP 2003265657 A 9/2003
JP 2003-310806 A 11/2003
JP 2003-310807 A 11/2003
JP 2004-008409 A 1/2004
JP 2004-089268 A 3/2004
JP 2004081241 A 3/2004
JP 2004159854 A 6/2004

(56) References Cited

FOREIGN PATENT DOCUMENTS

| | | | |
|---|---|---|---|
| JP | 05-237207 | B2 | 7/2013 |
| TW | 375965 | U | 12/1999 |
| TW | 514546 | B | 12/2002 |
| WO | 2004043550 | | 5/2004 |

* cited by examiner

GOLF CLUBS AND GOLF CLUB HEADS

CROSS REFERENCE TO RELATED APPLICATIONS

This application is a continuation application of U.S. patent application Ser. No. 13/366,869, entitled "Golf Clubs and Golf Club Heads," which was filed on Feb. 6, 2012, which is a continuation application of U.S. patent application Ser. No. 12/829,541 entitled "Golf Clubs and Golf Club Heads," which was filed on Jul. 2, 2010 (now U.S. Pat. No. 8,110,060), which is a divisional application of U.S. patent application Ser. No. 11/773,323 entitled "Golf Clubs and Golf Club Heads," which was filed on Jul. 3, 2007 (now U.S. Pat. No. 7,775,903) which is a continuation application of U.S. patent application Ser. No. 10/935,744 entitled "Golf Clubs and Golf Club Heads," which was filed on Sep. 8, 2004 (now U.S. Pat. No. 7,258,625), and all of which are herein incorporated by reference in their entirety.

FIELD OF THE INVENTION

The present invention relates to golf club heads and golf clubs including such golf club heads, as well as to methods for making such golf club heads. In at least some examples, golf club heads in accordance with this invention will be formed from one or more metal members and one or more fiber reinforced plastic (FRP) members.

BACKGROUND

Long carry and excellent directional stability are required in golf clubs and their associated golf club heads. In order to satisfy these requirements, a high degree of design freedom regarding the center of gravity and moment of inertia is sought in the structure of the golf club head. In recent years, in order to raise the degree of design freedom of the center of gravity and moment of inertia, a composite type of golf club head has been proposed in which a metal member is placed in a low position and a fiber reinforced plastic member is placed in a high position (see, for example, Japanese Patent No. 2773009 and Japanese Laid Open Patent Publication Nos. 59-90578 and 2002-336389). These documents are entirely incorporated herein by reference.

The carry when a golf ball is hit by a golf club head depends to a large extent on the initial velocity of the ball. On the other hand, the initial velocity of the ball depends on the amount of kinetic energy transmitted to the ball from the golf club head. Accordingly, the carry distance typically can be lengthened by increasing the amount of kinetic energy that is transmitted to the ball.

Following on from this, in order to increase the amount of kinetic energy that is transmitted to a golf ball, golf club heads have been proposed that include special features in the structure of the club head's face plate. See, for example, U.S. Pat. Nos. 6,354,962; 6,368,234; and 6,398,666. These patents are entirely incorporated herein by reference.

However, in these known golf club heads, because a large amount of kinetic energy is expended in deforming the golf club head at the moment the ball is hit, it has not been possible to sufficiently increase the initial velocity of the ball so as to lengthen the carry.

SUMMARY

The present invention was conceived in view of the above circumstances, and at least one aspect of this invention relates to providing golf club head structures that enable an initial velocity of a ball to be increased so as to thereby increase a driving distance of the ball.

Golf club head structures according to at least some examples of the present invention include a face plate formed from metal and at least a portion of a club head body (e.g., a crown and sole) formed from fiber reinforced plastic. A weighted body is provided inside a rearmost portion of the golf club head, and a low rigidity portion is provided in the crown of the club head extending from a vicinity of the face plate or a side of the club head body toward the rearmost portion of the golf club head, wherein a width of the low rigidity portion becomes gradually narrower as it approaches the rearmost portion. The low rigidity portion may act as at least one portion of a "deformation wave transmitting system," and the weighted body may act as at least a portion of a reflecting member for energy from the deformation wave.

In this type of golf club head structure, because the initial velocity of a ball can be increased, the carry when a ball is hit by the club head can be lengthened. Aspects of this invention also relate to golf clubs including such club heads and to methods of making such club heads.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

In the following description of various example embodiments of the invention, reference is made to the accompanying drawings, which form a part hereof, and in which are shown by way of illustration various example devices, systems, and methods in which aspects of the invention may be practiced. It is to be understood that other specific arrangements of parts, example devices, systems, and methods may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

Various examples of golf club head structures according to the present invention now will now be described.

Figure 1:
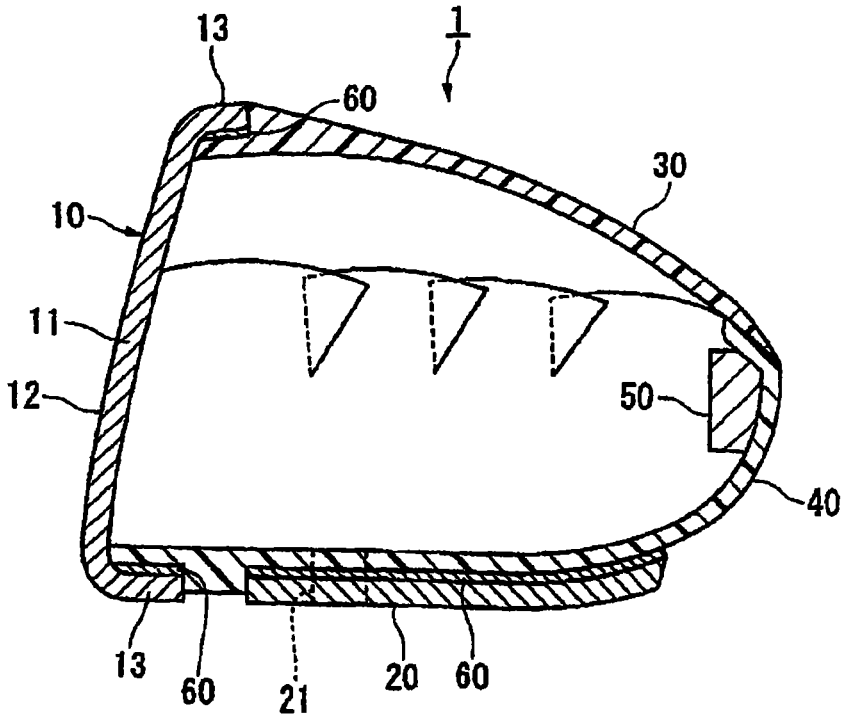
FIG. 1 is a cross-sectional view showing an example golf club head structure according to the present invention.

FIG. 1 is a cross-sectional view showing a golf club head 1 according to a first example of the present invention. This example golf club head structure 1 has a metal face plate 10 that has a face 11 and a flange 13 that is formed extending from an edge of the face 11 toward a side opposite from a hitting face 12 of the club head (i.e., the flange 13 extends in a direction away from the hitting face 12). The golf club head 1 further includes a metal sole plate 20, a crown 30, and a sole 40. The crown 30 and sole 40 of this example structure make up a main portion of the club head body and are made from fiber reinforced plastic. A weighted body 50 is provided inside a rearmost portion of the golf club head structure 1. Here, the rearmost portion is the portion located furthest to the rear of the golf club head 1 when the hitting face 12 of the face plate 10 faces to the front.

The various parts of the golf club head may be secured together in any desired manner without departing from the invention, including in conventional manners known in the art. In this illustrated golf club head 1 example, the flange 13 of the face plate 10 and the crown 30 and the sole 40 are adhered together at respective adhesion overlaps of each via a film type adhesive agent 60. The crown 30 and sole 40 also may be adhered together at respective adhesion overlaps of each in the vicinity of the rearmost portion. Conventional adhesives may be used as are known in the art.

The face plate 10 and sole plate 20 of this example golf club head 1 may be manufactured in any desired manner without departing from the invention, including in conventional manners known in the art, such as by casting, forging, machine cutting metal, etc. Also, while any desired type of material may be used for the face plate 10 and/or sole plate 20 of the golf club head structure 1, examples of suitable materials that may be used include titanium alloys, aluminum high strength alloys, stainless steels, etc. In at least some examples, in view of its balance between strength and specific gravity, titanium alloys advantageously may be used. Also, the face plate 10 and sole plate 20 may be made from the same material or from different materials without departing from the invention. Additionally, the face plate 10 and the sole plate 20 may be combined or separated. In particular, in at least some examples, because it is possible to easily lower the center of gravity of the golf club head 1, it may be preferable to use a material for the sole plate 20 that has a higher specific gravity than that of the face plate 10. As a more specific example, in at least some example club head structures 1, stainless steel may be used for the sole plate 20 and titanium alloy may be used for the face plate 10.

In order to increase the strength of the adhesion of the various parts together, in at least some examples of the invention, the surfaces of the face plate 10 and the sole plate 20 that are adhered to the crown 30 and/or sole 40 will previously undergo a roughening treatment (e.g., by blast processing, sanding, or the like) so that the surface roughness ("$R_a$") thereof is between 1 μm and 20 μm. Also, the surfaces of the face plate 10 and sole plate 20 that are adhered to the crown 30 and/or sole 40 may undergo degreasing processing, e.g., using methyl ethyl ketone, acetone, or the like, to further improve the bonding and increase the strength of adhesion of these parts.

As noted above and illustrated in FIG. 1, the flange 13 of the face plate 10 is the portion of the overall club head structure 1 by which the face plate 10 is adhered to the crown 30 and/or to the sole 40. While any desired flange 13 size may be used without departing from the invention, some aspects of the flange 13 size can help improve the structure and/or characteristics of the club head 1. For example, when the flange 13 is long, the strength of adhesion between the flange 13 of the face plate 10 and the crown 30 and/or sole 40 increases, but if it is too long, the weight of the golf club head 1 may increase too much. Accordingly, in at least some example structures 1, the flange portion 13 will be designed to have a length between 5 mm and 25 mm, and in some examples, the length may be between 10 mm to 15 mm.

A hole 21 may be formed in the sole plate 20 for inserting a pressure bag for use during the manufacture of the golf club head 1. The hole 21 may be a threaded hole (also known as a "bladder hole"). When the hole 21 is a threaded hole, after the pressure bag has been withdrawn from the threaded hole 21, a screw that fits the threaded hole 21 can be screwed into it enabling the hole 21 to be easily blocked and thereby closed off. A screw having a large specific gravity, such as one made from a tungsten alloy, may be used, as this enables the center of gravity of the overall golf club head structure 1 to be lowered even further.

The crown 30 may be formed as a single body by laminating a plurality of fiber reinforced plastic layers in which the reinforced fibers of each layer are aligned unidirectionally. These fiber reinforced plastic layers may be laminated such that the direction of the fiber alignment in each layer is orthogonal (or substantially orthogonal) to that of the layers sandwiching it. For example, layers in which the reinforced fibers are arranged at an angle of 0° to the hitting face 12 may be laminated alternatingly with layers in which the reinforced fibers are arranged at an angle of 90° to the hitting face 12. Alternatively, layers in which the reinforced fibers are arranged at an angle of +45° to the hitting face 12 may be laminated alternatingly with layers in which the reinforced fibers are arranged at an angle of −45° to the hitting face 12. In at least some examples, a structure in which layers whose reinforced fibers are arranged at an angle of +45° to the hitting face 12 are laminated alternately with layers whose reinforced fibers are arranged at an angle of −45° to the hitting face 12 may enable an initial velocity of a ball to be further increased when struck by the club head structure.

Figure 2:
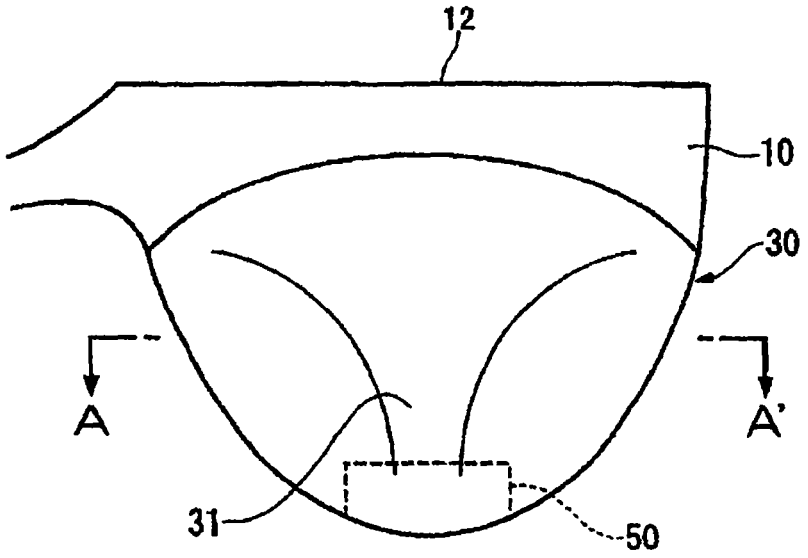
FIG. 2 is a top view of the golf club head structure shown in FIG. 1, further illustrating a convex portion of the golf club head structure.
Figure 3:
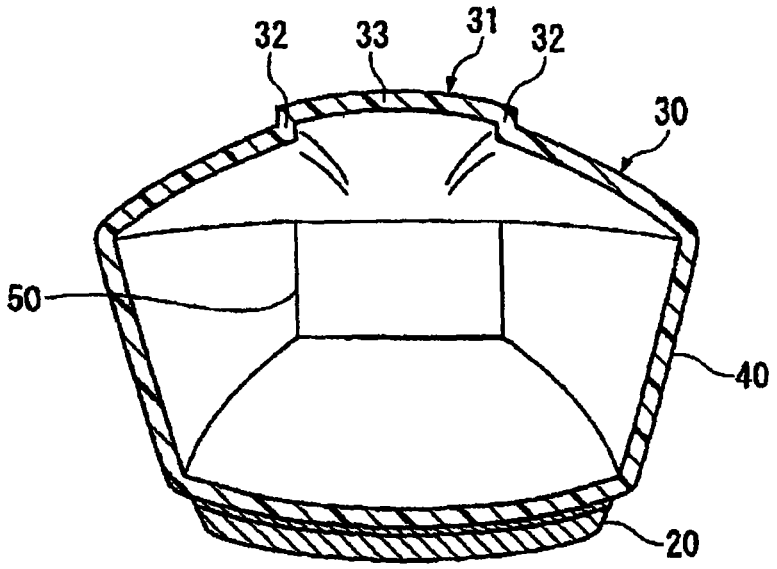
FIG. 3 is a cross-sectional view taken along line A-A' in FIG. 2.

As shown in FIGS. 2 and 3, a convex portion 31 may be provided in the crown 30. This convex portion 31 may be structured such that its width becomes gradually narrower as it approaches the rearmost portion of the club head structure 1, and it may protrude away from the club head interior space, e.g., in a substantially vertically upward direction. The convex portion 31, in at least some examples, may extend from the vicinity of the face plate 10 and/or the sides of the crown 30 toward the rearmost portion of the crown, at or near a location where the weighted body 50 is provided.

As shown in FIG. 3, two high rigidity portions 32 (e.g., portions whose thicknesses are greater than their surrounding portions and whose rigidities are higher than their surrounding portions) are formed at edge portions on both sides of the convex portion 31. In this manner, a low rigidity portion 33 (e.g., a portion whose thickness and rigidity both are less than those of the high rigidity portions 32) is formed between the high rigidity portions 32. The configuration of the low rigidity portion 33 corresponds to the configuration of the convex portion 31. Accordingly, in this example structure, the low rigidity portion 33 has a width that becomes gradually narrower as it approaches the rearmost portion of the crown 30 and extends from the vicinity of the face plate 10 and/or the sides of the crown to the rearmost portion of the crown 30.

In use of the club head structure 1, a deformation wave may be generated in the crown 30 when a ball is hit. However, by providing this low rigidity portion 33, this deformation wave is transmitted along the low rigidity portion 33. As a result, the deformation wave can be transmitted efficiently to the weighted body 50. The low rigidity portion 33 of this example acts as a deformation wave transmission system that transmits energy of the deformation wave away from and back toward the face plate 10 (and toward and away from the weighted body 50 reflecting member).

In at least some example club head structures 1 according to the invention, the Young's modulus of the crown 30 will be in a range between 10 and 100 GPa. When the Young's modulus of the crown 30 is in this range, the crown 30 typically may be deformed in a more suitable manner so that the amount of kinetic energy transmitted to the ball can be further increased.

The Young's modulus of the fiber reinforced plastic that forms the crown 30 in this example structure may be measured using a fiber reinforced plastic plate material obtained by the following method.

First, a fiber reinforced plastic plate material that is to be used as a test piece is manufactured. In manufacturing this fiber reinforced plastic plate material, a pre-preg of the same material as that used in the manufacture of the fiber reinforced plastic that forms the crown 30 is used. This pre-preg is cut to a suitable size and laminated to form a laminated body. The laminate structure and the alignment of the fibers of the pre-preg of the laminated body are made the same as those of the fiber reinforced plastic forming the crown. The laminated body for the test plate is formed under the same temperature and under the same pressure conditions as those employed when the golf club head is formed, to thereby form a fiber reinforced plate for the Young's modulus testing.

Next, the method used for measuring the Young's modulus using this fiber reinforced plastic plate material will be described. More specifically, in this example, the Young's modulus of this fiber reinforced plastic plate material is measured in a tension test as described below.

In this measuring procedure, first, both ends of the fiber reinforced plastic plate material (i.e., the test plate described above) are gripped by a gripping tool, and tensile stress then is applied to the fiber reinforced plastic plate material. At this time, the direction in which the tensile stress is applied corresponds to a direction along a line connecting a center point of the golf club head with the rearmost portion of the club head if the fiber reinforced plastic plate material had been incorporated into a crown 30 of a golf club head structure 1.

Next, the amount of strain experienced when this tensile stress is applied is measured using a strain gauge, and a relationship between the tensile stress and the amount of strain is plotted on a graph. Then, a range in which the amount of strain is 0.1% to 0.3% of the amount of absolute strain is extracted from this graph. Because the graph is essentially a straight line in this range, the inclination (or slope) of the graph is determined, and this inclination is taken as the Young's modulus of the fiber reinforced plastic material.

In at least some example club head structures 1, the thickness of the crown 30 will be maintained in a range between 0.4 and 2 mm. When the thickness of the crown 30 is 0.4 mm or more, the crown 30 typically deforms more suitably and remains structurally stable. As a result, not only can the amount of kinetic energy transmitted to the ball be further increased, but the strength of the overall golf club head structure 1 can be secured to a satisfactory degree. However, if the thickness of the crown 30 exceeds 2 mm, typically the weight of the crown 30 will increase to an undesired degree, and the center of gravity of the golf club head 1 tends to become somewhat higher. Additionally, the quantity of fiber reinforced plastic required for the structure increases, which thereby increases the manufacturing costs.

The sole 40 1 may be formed as a single body by laminating a plurality of fiber reinforced plastic layers in which the directions of the reinforced fibers of each layer are aligned unidirectionally. These fiber reinforced plastic layers may be laminated such that the direction of fiber alignment of each layer is orthogonal to that of the layers sandwiching it. For example, layers in which the reinforced fibers are arranged at an angle of 0° to the hitting face 12 may be laminated alternately with layers in which the reinforced fibers are arranged at an angle of 90° to the hitting face 12. Angles of ±45° for alternating layers also may be used without departing from the invention.

Any desired materials may be used for the fiber reinforced plastic materials forming the crown 30 and/or sole 40 without departing from the invention, including conventional materials known and used in the art. Examples of the matrix resin that may be contained in the fiber reinforced plastic that forms the crown 30 and/or the sole 40 include: epoxy resin, vinyl ester resin, unsaturated polyester resin, polyimide resin, maleimide resin, and phenol resin. Examples of the reinforcing fiber include: carbon fiber, glass fiber, aramid fiber, boron fiber, silicone carbide fiber, high strength polyethylene, PBO fiber, and stainless steel fiber. Because of its excellent specific strength and modulus, carbon fibers may be used as the reinforcing fiber in at least some examples of this invention.

Likewise, any material may be used for the weighted body 50 without departing from the invention. In at least some examples of the invention, the weighted body 50 may be comprised of a metal having a large specific gravity, such as tungsten, copper, lead, or the like. In some examples, a resin combined with particles of tungsten or copper may be used (e.g., such materials can have favorable formativeness properties). As the resin in such materials, a matrix resin the same as that used for the fiber reinforced plastic of the crown 30 or sole 40 may be used, as in this manner the weighted body 50 may be easily integrated into the structure with the crown 30 and/or the sole 40. The weighted body 50 may be structured and positioned so that it enables a deformation wave generated in the crown 30 and transmitted by the transmission system to be reflected back forward toward the front of the club head structure 1 and toward the face plate 10. In this manner, at least some of the energy included in the deformation wave as a result of hitting the ball can be returned as kinetic energy to the ball via the reflected wave.

Weighted bodies 50 of various different weights also may be used without departing from this invention. For example, in some example structures 1, the mass of the weighted body 50 will be in the range of 10 to 50 g. In at least some golf club head structures 1, if the mass of the weighted body 50 is 10 g or more, the deformation wave can be reflected more efficiently. As a result, the amount of kinetic energy that acts on the ball can be further increased, as described above. However, if the mass of the weighted body 50 exceeds 50 g, the golf club head 1 may become excessively heavy and more difficult to use, at least in some example structures.

The adhesive agent 60 may be of various different compositions without departing from the invention. In at least some examples, the adhesive agent 60 may be a film type adhesive agent having a uniform thickness. When such an adhesive agent is used, it is more difficult for irregularities to be generated and consistent adhesion strength can be obtained more easily. Examples of suitable resins for forming the film type adhesive agent 60 include, but are not limited to: epoxy resin, polyester resin, and acrylic resin. Epoxy resins are used in at least some examples of this invention because of their excellent adhesion strength. More specifically, in at least some examples of the invention, the epoxy resin composition may contain an elastomer component and a hardening agent component in addition to the epoxy resin component. Specific examples of suitable elastomer components for use in accordance with at least some examples of this invention include carboxy-terminated butadiene acrylonitrile copolymers (CTBN) and the like.

Film type adhesive agent 60, when used, also may be modified to contain a base material formed from fabric, such as an unwoven fabric or a woven fabric. When the film type adhesive agent 60 contains a base material such as a fabric, the ease of handling and adhesiveness thereof may be improved. Moreover, even if stress is generated in the adhesive agent after it has hardened so that minute cracks are generated, the fabric material may help prevent the cracks from extending or developing further. As a result, the breaking strength of the adhesive agent can be improved. Examples of materials useful as the unwoven and woven fabrics for the base material of the film type adhesive agent 60 include: polyester fiber, nylon fiber, aramid fiber, acrylic fiber, and glass fiber.

An example method of manufacturing a golf club head according to the above example now will be described in more detail. First, a metal face plate having a face and a flange, and a metal sole plate are separately obtained, e.g., by casting, forging, machine cutting metal, or the like.

Next, in preform manufacturing steps, a first preform is manufactured by preliminarily forming a pre-preg into the configuration of the sole. In addition, a second preform is manufactured by preliminarily forming a pre-preg into the configuration of the crown. When manufacturing the first preform (the sole preform in this example), an aperture portion is formed such that a threaded hole that is formed in the sole plate is not blocked. In this context, the term "preliminarily forming" or "preliminary forming" refers to the laminating of a plurality of pre-pregs so as to form a single body using the adhesive force thereof, and then forming this into a configuration whose outline is close to that of the ultimate crown or sole.

In manufacturing these preforms, before the "preliminary forming" steps, it is preferable that breakage lines be formed in advance in the pre-pregs. By forming the breakage lines in advance in the pre-pregs, when the stacked pre-pregs are undergoing the preliminary forming steps, the configurations of the crown and sole, which are curved configurations, are easily formed by adhering together end portions of the breakage lines.

Figure 4:
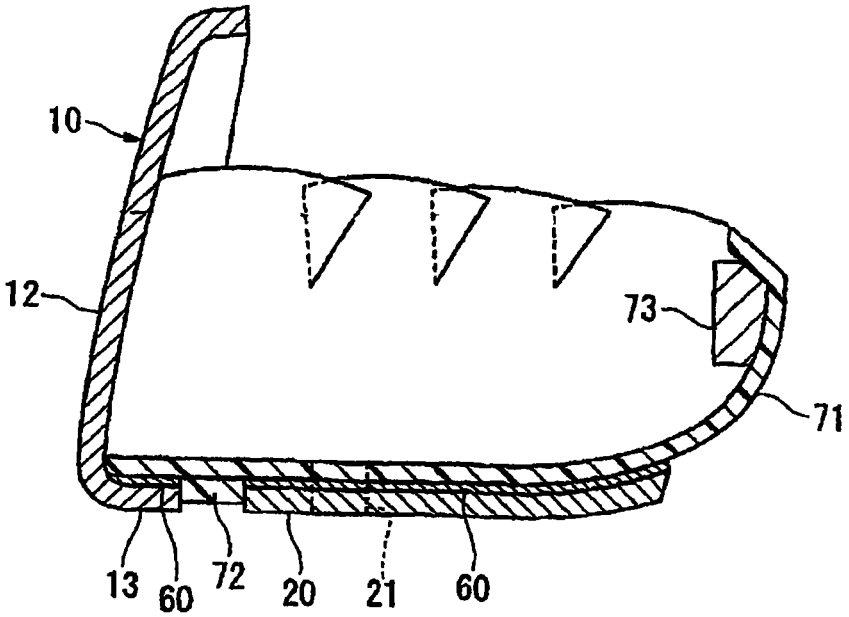
FIG. 4 is a cross-sectional view showing one step in an example procedure for manufacturing the golf club head structure shown in FIG. 1.

Next, in an assembly step, as shown in FIG. 4, a bottom surface of the first preform 71 is adhered to a top surface of the sole plate 20 via a film type adhesive agent 60. In addition, the first preform 71 and the flange 13 of the face plate 10 are adhered together via a film type adhesive agent 60. At this time, the reinforcing fibers in the first preform 71 are aligned, in their respective layers, to 0° and 90° relative to the hitting face 12. Next, a pre-preg 72 that has been laminated such that the direction of alignment of the reinforcing fibers thereof is orthogonal to that of the hitting surface 12 is further adhered in the vicinity of the contact portion between the first preform 71 and the flange 13.

A metal-containing compound next is prepared by mixing a powder of a metal having a high specific gravity (such as tungsten or copper) in a precursor of a matrix resin. This metal-containing compound then is formed into a belt shape and is adhered to the inside of the rearmost portion of the first preform 71 so as to form a weighted body preform 73.

Figure 5:
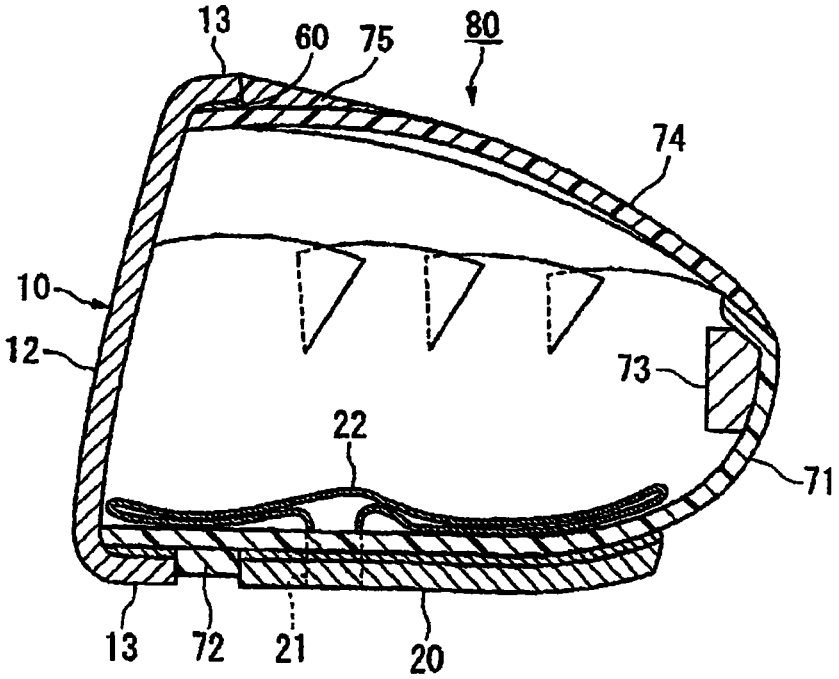
FIG. 5 is a cross-sectional view showing another step in an example procedure for manufacturing the golf club head structure shown in FIG. 1.

Next, as shown in FIG. 5, a pressure bag 22 is inserted via hole 21 in the sole plate 20. While any desired material may be used at the pressure bag 22, examples of suitable materials include: silicone rubber, nylon, and polyester.

The second preform 74 (for the crown) then is placed on top of the first preform 71, and the second preform 74 and the flange 13 of the face plate 10 are adhered together via a film type adhesive agent 60. At this time, the reinforcing fibers in the second preform 74 are aligned in their respective layers at angles of +45° or −45° to the hitting face 12. Next, a pre-preg 75 whose reinforcing fibers have been aligned in their respective layers at angles of +45° or −45° to the hitting face 12 is adhered to the vicinity of the contact portion between the second preform 74 and the flange 13. As a result of the above steps, a molded product precursor 80 is obtained.

Figure 6:
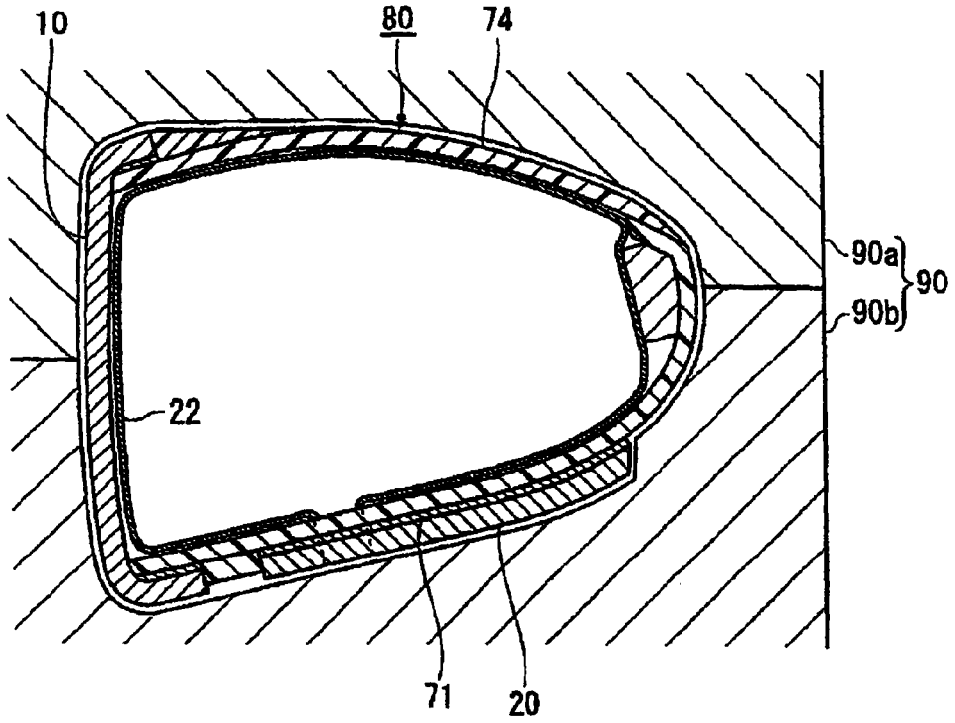
FIG. 6 is a cross-sectional view showing another step in an example procedure for manufacturing the golf club head structure shown in FIG. 1.

Next, in a bladder molding step, bladder molding is performed on this molded product precursor 80. As a more specific example, as shown in FIG. 6, the molded product precursor 80 is placed inside a mold 90 formed by an upper mold 90*a* and a lower mold 90*b*. The mold 90 then is closed, and the pressure bag 22 is inflated by supplying air (or other gas) to the pressure bag 22. A groove whose width becomes gradually narrower as it approaches the rearmost portion of the club head is formed at a position in the upper mold 90*a* of the mold 90 that corresponds to a portion extending from the vicinity of the face plate 10 or a side of the second precursor 74 of the molded product precursor 80 to the rearmost portion thereof.

As a result, the first preform 71 and the second preform 74 are pressed against the mold 90 by the inflated pressure bag 22. At the same time, the matrix resins of the respective preforms 71 and 74 undergo heat curing and are consequently molded and set. At the time of this molding, the precursor of the weighted body preform 73 that is adhered to the inside of the rearmost portion of the first preform 71 is cured so as to form the weighted body 50. Moreover, because a portion of the top surface of the second preform 74 is pressed into the groove in the upper mold 90*a*, a convex portion whose width becomes gradually narrower as it approaches the rearmost portion of the club head is provided in the crown extending from the vicinity of the face plate or the side of the crown toward the rearmost portion.

The mold 90 then is opened and the resulting molded product is extracted. In addition, the pressure bag 22 is taken out via the hole 21. Finally, a screw is screwed into the hole 21 in the sole plate 20 so as to close off the threaded hole and thereby enable a golf club head structure to be obtained.

In the above-described example, a weighted body 50 is provided inside the rearmost portion of the golf club head 1, and a low rigidity portion 33 whose width gradually becomes narrower as it approaches the rearmost portion of the crown 30 is provided in the crown 30 (see, for example, FIGS. 1-3). When a ball is hit with this golf club head 1, the resulting shock creates a deformation wave in the crown 30 that moves toward the rear of the club head structure 1. However, in this golf club head structure 1, the deformation wave is transmitted to the rearmost portion along the low rigidity portion 33, and at least some portion of the energy in the deformation wave then is able to be reflected back toward the front of the club head 1 by the weighted body 50 provided in the rearmost portion of the crown 30 (via the deformation wave transmission system 33). It also is possible to make this reflection wave act on the ball via the face plate 10. Accordingly, because it is possible to transmit this reflected energy to the ball (i.e., energy that has hitherto been lost due to deformation), it is possible to suppress, at least to some degree, the loss of kinetic energy that is caused by deformation of the golf club head 1. Namely, because the amount of kinetic energy that is transmitted to the ball is increased (due to the reflected wave), it is possible to increase the ball's initial velocity and thereby lengthen the carry.

One example of a desirable embodiment of the present invention is described above. However, as those skilled in the art will readily appreciate, the present invention is not limited to this example embodiment. Additions, omissions, substitutions, and other modifications may be made without departing from the spirit or scope of the present invention. Various additional example golf club head structures according to the invention are described in more detail below.

Figure 7:
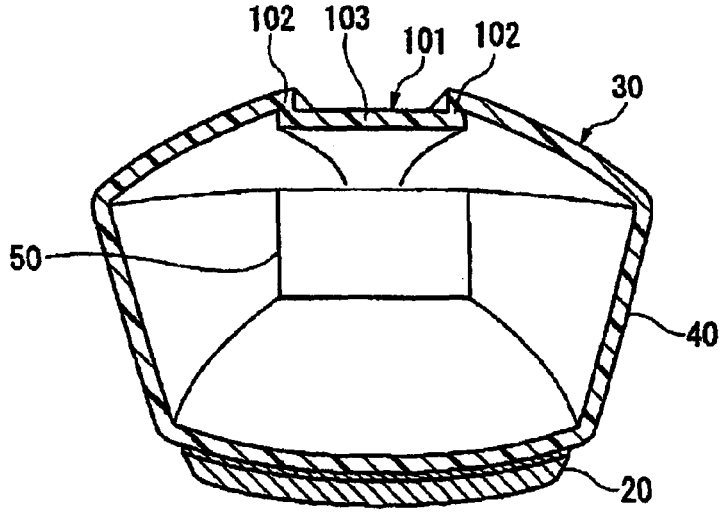
FIG. 7 is a cross-sectional view showing another example of a golf club head structure according to the present invention.

Another example golf club head structure according to the invention is illustrated in FIG. 7. In this example structure, a concave portion 101, which is recessed into the interior space of the club head, e.g., in a substantially vertical direction from the top surface of the crown 30, is provided. This concave portion 101 may extend from the vicinity of the face plate or a side of the crown 30 toward and to the rearmost portion of the crown 30 in a manner similar to the convex portion 31 of the above example structure. The width of this concave portion 101 may be structured so as to become gradually narrower as it approaches the rearmost portion of the crown 30. By providing this type of concave portion 101, two high rigidity portions 102, whose thicknesses are greater than those of the surrounding portions and whose rigidities are higher than those of the surrounding portions, are formed. In addition a, low rigidity portion 103 (e.g., whose width becomes gradually narrower as it approaches the rearmost portion of the crown 30 and whose thickness and rigidity are both less than those of the high rigidity portions 102) is formed between the high rigidity portions 102.

Figure 8:
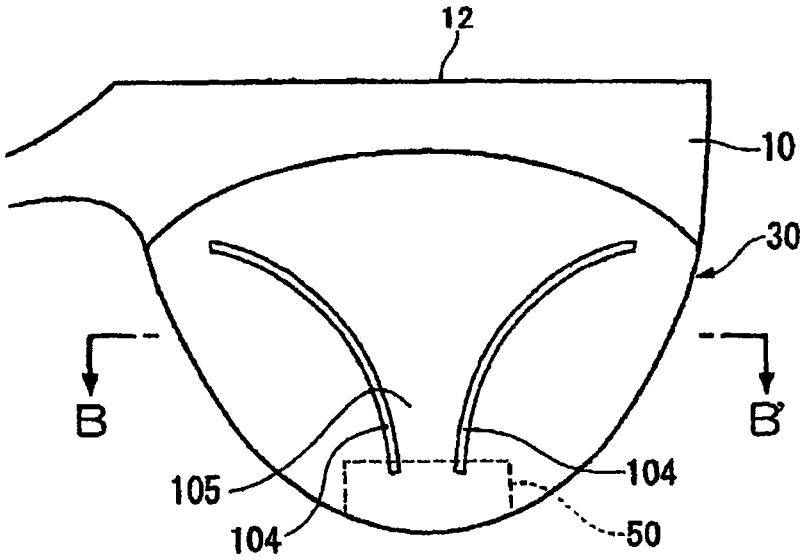
FIG. 8 is a top view showing still another example of a golf club head structure according to the present invention.
Figure 9:
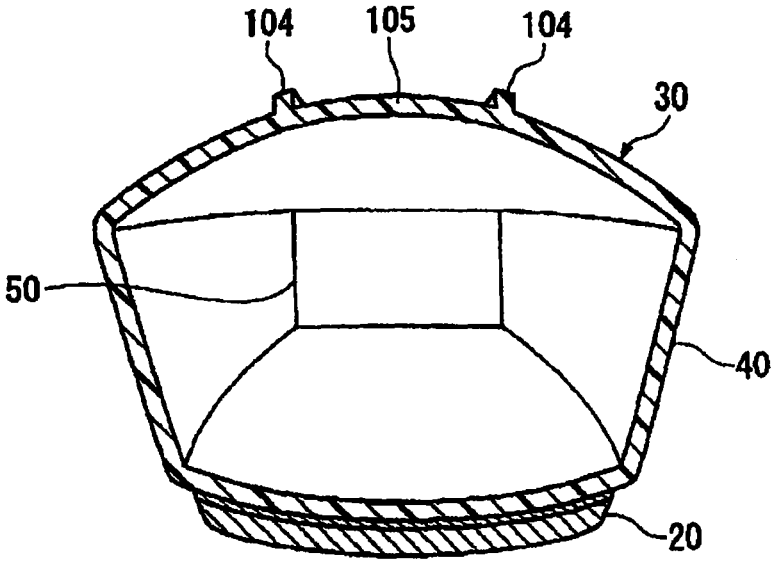
FIG. 9 is a cross-sectional view taken along the line B-B' in FIG. 8.

Another example golf club head structure according to the invention is illustrated in conjunction with FIGS. 8 and 9. In this example structure, two raised ribs 104 are provided in the crown 30 that extend from the vicinity of the face plate 10 and/or a side of the crown 30 to the rearmost portion of the crown 30. In the illustrated example, the space between the ribs 104 becomes gradually narrower as the ribs 104 approach the rearmost portion of the crown 30. Because the portions of the crown 30 where the ribs 104 are provided have an increased thickness, these portions 104 become high rigidity portions whose rigidity is higher than that of their surrounding portions. Moreover, because the portion of the crown 30 that is included between the ribs 104 is thinner than the portions where the ribs 104 are provided, this intermediate portion forms a low rigidity portion 105 of the crown 30 that has a low rigidity as compared to the ribs 104. Because the space between the two ribs 104 becomes gradually narrower as the ribs 104 approach the rearmost portion of the crown 30, the width of the low rigidity portion 105 that is included between these ribs 104 becomes gradually narrower as it approaches the rearmost portion of the crown 30.

Many variations in the structure illustrated in FIGS. 8 and 9 may be used without departing from the invention. For example, as illustrated in FIG. 9, the ribs 104 of this example structure are provided so as to face toward the outside of the golf club head (i.e., the ribs 104 are raised on the outer surface of the crown 30 and extend outwardly). However, if desired, some or all of the ribs 104 may be provided so as to face toward the inside of the golf club head (i.e., one or more of the ribs 104 may be raised out of the inner surface of the crown 30 and extend toward the inside of the club head), and the same effect increased rigidity will be achieved. Furthermore, while the structure illustrated in FIG. 9 shows the ribs 104 as solid members, the ribs 104 also may be hollow without departing from the invention. Additionally, the ribs 104 may be integrally formed as part of the crown 30 structure (as a unitary, one-piece construction), or they may be separate elements attached to the crown 30 in some manner.

Figure 10:
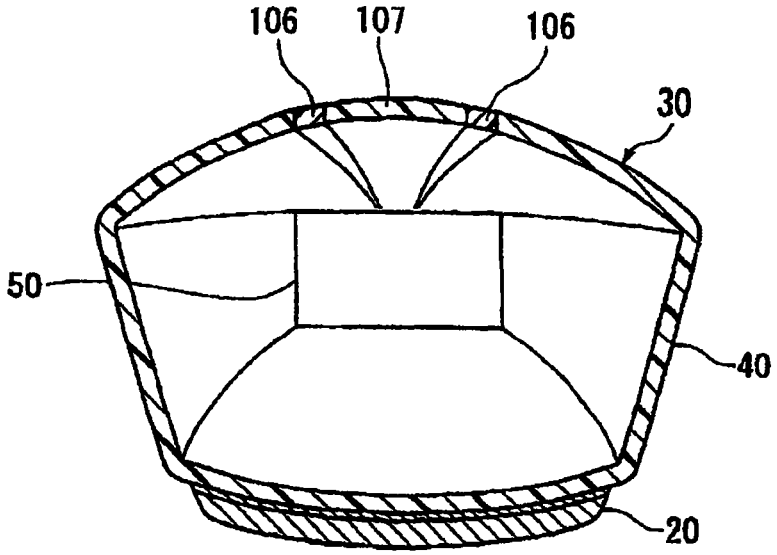
FIG. 10 is a cross-sectional view showing another example of a golf club head structure according to the present invention.

FIG. 10 illustrates still another example golf club head structure according to the invention. As shown in FIG. 10, it also is possible to provide two high rigidity portions 106 without providing a raised region as shown in some of the other example embodiments. More specifically, as shown in FIG. 10, two high rigidity portions 106 are formed from a material having a higher rigidity than that of their surrounding portions. These high rigidity portions 106, while the same thickness as the remainder of the crown 30, extend from the vicinity of the face plate and/or the side of the crown to the rearmost portion of the crown 30. Again, the space 107 between the high rigidity portions 106 becomes gradually narrower as it approaches the rearmost portion of the crown 30. Because the portion 107 between the high rigidity portions 106 has a lower rigidity than that of the surrounding high rigidity portions 106, this portion 107 forms a low rigidity portion 107 whose width becomes gradually narrower as it approaches the rearmost portion of the crown.

Figure 11:
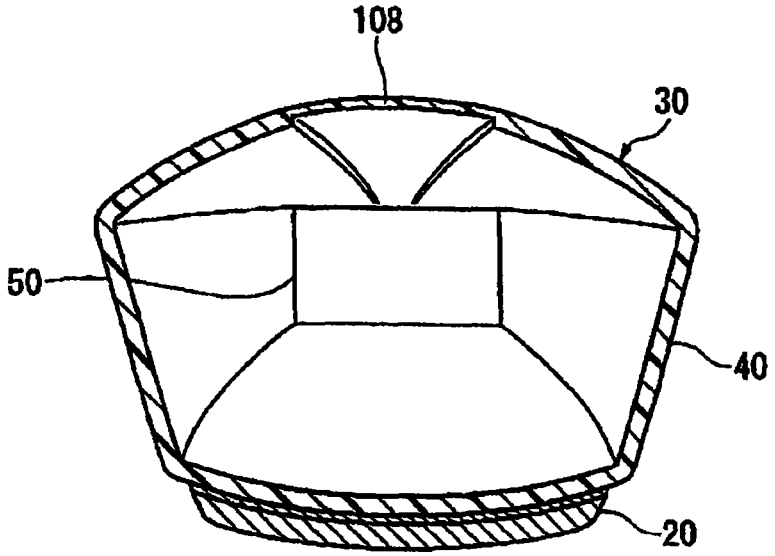
FIG. 11 is a cross-sectional view showing yet another example of a golf club head structure according to the present invention.

Another example golf club head structure according to this invention is illustrated in FIG. 11. Rather than providing a raised or thicker portion of the crown 30 as the high rigidity portions, as illustrated in some of the example structures above, it also is possible to provide a portion of the crown 30 that is thinner than its surrounding portions and that extends from the vicinity of the face plate of the inner (or outer) surface of the crown 30 toward the rearmost portion of the crown 30. The width of this thin portion 108 may become gradually narrower as it approaches the rearmost portion of the crown 30. Because the rigidity of the thin portion 108 is less than that of its surrounding portions, it forms a low rigidity portion 108 and functions as a deformation wave transmission system in the manner of the low rigidity portions described above.

Figure 12:
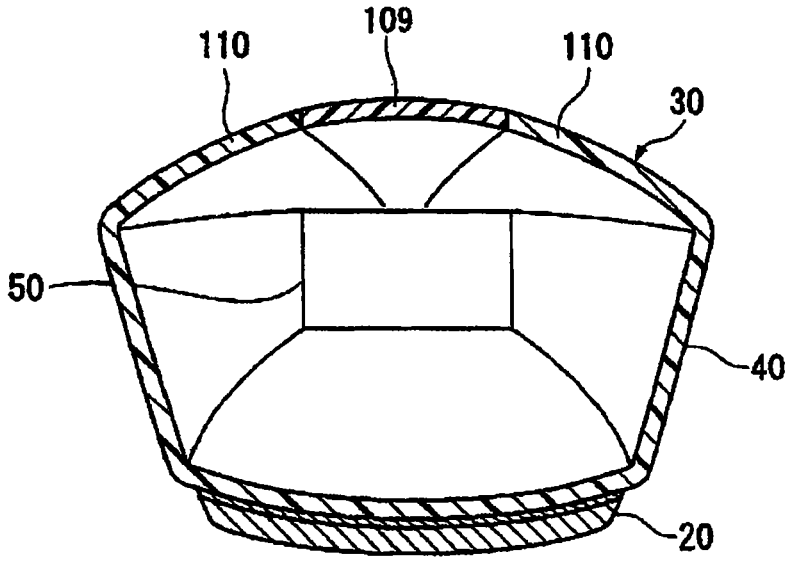
FIG. 12 is a cross-sectional view showing another example of a golf club head structure according to the present invention.

As shown in FIG. 12, it also is possible to provide a low rigidity portion 109 by forming a portion 109 of the crown 30 from a material having a lower rigidity than that of its surrounding portions and having a lower rigidity than the remainder of the crown 30. This portion 109 may extend from the vicinity of the face plate and/or the sides of the crown 30 toward the rearmost portion of the crown, as generally described above. The width of this low rigidity portion 109 may become gradually narrower as it approaches the rearmost portion of the crown 30. This type of low rigidity portion 109 also may be provided by providing high rigidity portions 110 that are formed from a material having a high rigidity in portions on both sides of the low rigidity portion 109.

Deformation waves also can be efficiently transmitted to and/or away from a weighted body 50 via the low rigidity portions as described in conjunction with FIGS. 7-12 above.

Moreover, in the above described examples, the direction of alignment of the reinforced fibers in the crown 30 may be controlled such that layers with reinforced fibers arranged at an angle of 0° to the hitting face are laminated alternately and sandwiched between layers with reinforced fibers arranged at an angle of 90° to the hitting face. Alternatively, the direction of alignment of the reinforced fibers in the crown 30, in at least some examples of the invention, may be controlled such that layers with reinforced fibers arranged at an angle of +45° to the hitting face are laminated alternately and sandwiched between layers with reinforced fibers arranged at an angle of −45° to the hitting face. In at least some example structures according to the invention, it is sufficient if the angles of orientation of the layers lie within a range from 0° to ±90°. Within this range, in at least some examples, it is preferable if the range be maintained between ±10° to ±80°, as this may provide a faster initial ball velocity. Likewise, the direction of the orientation of the reinforced fibers in the sole also may be maintained in the range of 0° to ±90° relative to the hitting face, and in some examples between ±10° to ±80°, although other arrangements and orientation directions also may be used without departing from the invention.

If desired, in at least some examples of the invention, the reinforcing fibers contained in the fiber reinforced plastic need not be aligned within a given layer and/or need not be arranged in orthogonally arranged unidirectional layers. Moreover, in at least some example structures, woven fabrics also may be used.

In addition, in the example structures described above, the flange 13 of the face plate 10 and the crown 30 and sole 40, and also the sole plate 20 and the sole 40, are adhered together using a film type adhesive agent. Other means of securing these members together also may be used, however, without departing from the invention. For example, one or more mechanical connectors may be used. Welding or soldering also may be used, if desired. As still another example, a liquid type adhesive agent may be used without departing from the invention. In examples where a liquid type adhesive agent is used, when forming a three-dimensional shape such as a golf club head, sufficient care must be taken to provide the coating in a relatively uniform thickness and width. Coating unevenness and/or thickness unevenness of the adhesive agent may, in at least some instances, cause the adhesive strength of the adhesive coating to be reduced, thereby making it difficult to obtain a golf club head having a consistent strength.

If desired, it also is possible to provide a decorative layer or indicia on any surface of the golf club head, including the hitting face. When a decorative layer or indicia is provided, the design of the golf club head may be more aesthetically pleasing. Printing, engraving, and other conventional marking systems and methods may be used to provide the decorative information or indicia on the club head, if desired.

Various examples of the production of golf club head structures, including structures according to the present invention and results obtained using such structures, are provided below. Those skilled in the art will recognize, however, that the scope of the present invention is in no way limited to these examples or the results achieved thereby.

Example 1

First, a titanium alloy face plate equipped with a face having a thickness of 2.8 mm and a flange having a thickness of 1.5 mm and a stainless steel (SUS 314) sole plate having a thickness of 1.5 mm were separately forged. Next, surface roughening treatments were performed on the flange surfaces of the sole plate and the face plate by blast working, and these surfaces then were degreased using acetone.

Next, in a first preform manufacturing step, pre-pregs (made of PYROFIL® TR350, manufactured by Mitsubishi Rayon Co., Ltd.) with carbon fibers arranged in two intersecting directions were impregnated with epoxy resin and were formed in advance into the general configuration of the sole of the golf club head, thereby forming a first preform (having a thickness of 1.5 mm). At this time, an aperture portion was formed in the first preform so that the threaded hole in the sole plate would not be obstructed by the sole preform.

Next, in an assembly step, as is shown in FIG. 4, the bottom surface of the first preform 71 was adhered to the top surface of the sole plate 20 via a film type adhesive agent 60. In addition, the first preform 71 was adhered to the flange 13 of the face plate 10 via a film type adhesive agent 60. Next, a pre-preg 72 whose carbon fibers were aligned in a direction running 0° relative to the hitting face 12 and that had a thickness of 0.25 mm was further adhered in the vicinity of the contact portion between the first preform 71 and the flange 13.

A tungsten powder then was mixed in an epoxy resin composition, and the resulting tungsten-containing mixture was formed into a belt shape having a width of 10 mm. Next, 30 g of this tungsten-containing mixture that was formed into a belt shape was measured out and was adhered to the inside of the rearmost portion of the first preform 71. As a result, a weighted body preform 73 was obtained.

Subsequently, as is shown in FIG. 5, a pressure bag 22 formed from silicone rubber was inserted into the first preform 71 via the threaded hole 21 in the sole plate 20 (and the corresponding opening provided in the first preform 71).

In the second preform manufacturing step, four layers of the above described pre-pregs were laminated such that the directions of the carbon fibers thereof were aligned and arranged in separate layers at angles of ±45° relative to the hitting face. As a result, a second preform (having a thickness of 0.5 mm) that was preliminarily formed in the shape of the crown of a golf club head was obtained. This second preform 74 then was placed on top of the first preform 71, and the second preform 74 and the flange 13 of the face plate 10 were adhered together via a film type adhesive agent 60. Next, a pre-preg 75 having a thickness of 0.5 mm and whose carbon fibers had been aligned at angles of ±45° relative to the hitting face 12 was further adhered at the vicinity of the contact portion between the second preform 74 and the flange 13. In this manner, a molded product precursor 80 was obtained.

Next, an internal pressure molding step, as shown in FIG. 6, was performed. More specifically, the molded product precursor 80 was placed inside a mold 90 formed by an upper mold 90*a* and a lower mold 90*b*. The mold 90 then was closed by a hydraulic press, and the pressure bag 22 then was inflated by supplying air to the pressure bag 22. The upper mold 90*a* that was used in this example had a groove having a depth of 3 mm and whose width became gradually narrower as it approached the rearmost portion of the crown. This groove was provided at a position that corresponded to a portion of the crown extending from the vicinity of the face plate 10 of the molded product precursor 80 to the rearmost portion thereof.

The first preform 71 and the second preform 74 were pressed against the mold 90 by the inflated pressure bag 22. At the same time, the matrix resins of the respective preforms underwent heat curing and were consequently molded and set. As a result of this molding, the first preform 71 and the pre-preg 72 formed the sole 40, and the second preform 74 and the pre-preg 75 formed the crown 30. In addition, the weighted body preform 73 formed the weighted body 50, and a convex portion whose width became gradually narrower as it approached the rearmost portion of the club head structure was provided in the crown 30 extending from the vicinity of the face plate to the rearmost portion of the crown 30.

Next, the mold was opened, and the obtained molded product was extracted. In addition, the pressure bag 22 was taken out via the hole 21. Finally, a tungsten alloy screw was screwed into the hole 21 in the sole plate so as to close off the threaded hole and thereby enable a golf club head to be obtained.

Example 2

A golf club head was obtained in the same manner as in Example 1 except that no groove was formed in the upper mold. This resulting golf club head was the same as the golf club head of Example 1 except that no convex portion was provided.

Example 3

A golf club head was obtained in the same manner as in Example 2 except that a second preform was obtained by laminating pre-pregs such that the directions of the carbon fibers thereof were alternately 0° and 90° relative to the hitting face.

Example 4

In order to make a comparison with Examples 1 to 3, a titanium alloy golf club head whose crown had a thickness of 0.5 mm and whose sole had a thickness of 1.5 mm was used.

Measurement of Initial Velocity of Ball:

Using the golf club heads of Examples 1 to 4, the initial velocity of a golf ball that was hit at a head velocity of 50 msec was measured 30 times using a laser light method. The average values that were obtained are shown in Table 1.

TABLE 1

| | Example 1 | Example 2 | Example 3 | Example 4 |
|---|---|---|---|---|
| Ball Initial Velocity (m/sec) | 77.5 | 76.5 | 76.0 | 75.5 |

As shown in Table 1, the ball initial velocity obtained using a golf club head in which a weighted body was provided inside the rearmost portion was faster than that obtained using a titanium alloy golf club. From this result, it can be assumed that the carry would be lengthened. In particular, the golf club head of Example 1, in which the directions of alignment of the reinforcing fibers in the crown are ±45° relative to the hitting face, and in which a convex portion is provided so that a low rigidity portion is formed, providing the fastest ball initial velocity. Therefore, it can be assumed that this golf club head would enable the driving distance to be lengthened the most.

Golf club heads of the type described above may be formed into golf clubs by attaching a shaft to the head and a grip to the shaft in any desired manner, including in conventional manners known in the art. For example, the shaft may be attached to the head using mechanical connectors, threads, screws, bolts, adhesives, and/or the like. Grips also may be attached to the shafts using adhesives, or the like. Conventional shaft materials (e.g., steel, graphite, etc.) and grip materials (e.g., polymers, synthetic rubbers, leathers, etc.) also may be used without departing from this invention.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head, comprising:

a face plate formed from metal, wherein the face plate includes a hitting face and a flange extending rearwardly from the hitting face;

a club head body formed from fiber reinforced plastic, wherein the club head body is formed separately from the face plate and is attached to the face plate, the club head body comprising a crown and a sole;

a sole plate, wherein the sole plate is formed separately from the face plate and the club head body and is attached to the club head body, wherein the flange is connected to the club head body, wherein the flange is connected to the crown of the club head body, and wherein the sole plate is spaced rearwardly and apart from the flange; and wherein the crown further comprises a first rib and a second rib extending from the crown toward an interior space of the golf club head and wherein each rib is oriented in a front to rear direction, and wherein a space between the first rib and the second rib becomes gradually narrower as it extends toward a rearmost portion of the club head body.

2. A golf club head, comprising:

a face plate formed from metal;

a club head body formed from fiber reinforced plastic, wherein the club head body is formed separately from the face plate and is attached to the face plate, the club head body comprising a crown and a sole;

a sole plate, wherein the sole plate is formed separately from the face plate and the club head body and is attached to the club head body, wherein the sole plate is formed of a different material than the club head body, and wherein the sole plate has a higher density than the club head body;

wherein the face plate includes a hitting face and a flange extending rearwardly from the hitting face, wherein the flange is connected to the club head body, wherein the flange is connected to the sole of the club head body, and wherein the sole plate is spaced rearwardly and apart from the flange; and wherein the crown further comprises a first rib and a second rib, where each rib is oriented in a front to rear direction and extends from the crown toward an interior space of the golf club head, and wherein a space between the first rib and the second rib becomes gradually narrower as it extends toward a rearmost portion of the club head body.

3. A golf club head according to claim 2, wherein the sole plate is formed of a different material than the club head body.

4. A golf club head according to claim 3, wherein the sole plate has a higher density than the club head body.

5. A golf club head according to claim 4, wherein the sole plate has a higher density than the face plate.

6. A golf club head according to claim 2, wherein a Young's modulus of the fiber reinforced plastic forming the club head body is 10 Gpa to 100 GPa.

7. A golf club head according to claim 2, wherein a thickness of the crown is in a range from 0.4 mm to 2 mm.

8. A golf club head according to claim 2, wherein the golf club head further comprises:

a weighted member provided inside a space defined by the club head body and the face plate, wherein the weighted member is provided at the rearmost portion of the golf club head.

9. A golf club head according to claim 2, wherein the flange has a length between 5 mm and 25 mm.

10. A golf club head according to claim 2, wherein the flange has a length between 10 mm and 15 mm.

11. A golf club head according to claim 2, wherein the crown includes a concave portion recessed from a main surface of the crown into the interior space of the club head body.

12. A golf club head according to claim 2, wherein the crown includes a convex portion that protrudes from a main surface of the crown.

13. A golf club head according to claim 2, wherein the club head body is formed from a plurality of fiber-reinforced layers.

14. A golf club head according to claim 13, wherein the club head body includes a first layer of fiber reinforced plastic having fibers aligned in a first direction and a second layer of fiber reinforced plastic having fibers aligned in a second direction that is different from the first direction.

15. A golf club head according to claim 14, wherein the first direction is substantially orthogonal to the second direction.

16. A golf club head according to claim 15, wherein the first direction is at an angle of approximately 0° with respect to a hitting surface of the face plate and the second direction is at an angle of approximately 90° with respect to the hitting surface.

17. A golf club head according to claim 15, wherein the first direction is at an angle of approximately +45° with respect to a hitting surface of the face plate and the second direction is at an angle of approximately −45° with respect to the hitting surface.

18. A golf club, comprising:

a golf club head according to claim 2; and a shaft attached to the golf club head.

* * * * *